United States Patent [19]

Hildering et al.

[11] 3,960,677

[45] June 1, 1976

[54] ACID ZINC ELECTROPLATING

[75] Inventors: Roelof Hildering, Vianen, Netherlands; Anton Mudrak, Broadview Heights, Ohio

[73] Assignee: The Harshaw Chemical Company, Cleveland, Ohio

[22] Filed: Sept. 27, 1974

[21] Appl. No.: 510,090

[52] U.S. Cl. ..... 204/55 R

[51] Int. Cl.[2] ..... C25D 3/22

[58] Field of Search ..... 204/55 R, 43 Z, 44, 204/114

[56] References Cited

UNITED STATES PATENTS

| | | | |
|---|---|---|---|
| 3,594,291 | 7/1971 | Todt et al. | 204/55 R |
| 3,672,971 | 6/1972 | Senge et al. | 204/55 R |
| 3,748,237 | 7/1973 | Creutz | 204/55 R |

*Primary Examiner*—G. L. Kaplan

[57] ABSTRACT

Bright zinc deposits are obtained from an acid bath containing a carboxy terminated anionic wetting agent and a brightener comprising a heterocyclic compound selected from the group consisting of furans, thiophenes and thiazoles.

7 Claims, No Drawings

ACID ZINC ELECTROPLATING

FIELD OF THE INVENTION

This invention pertains to improvements in the electrodeposition of bright acid zinc from an aqueous acid plating bath. More particularly, the invention relates to the use of specific brighteners and wetting agents in acid zinc plating baths to give fully bright electrodeposits over a wide spectrum of current densities.

DISCUSSIONS OF THE PRIOR ART

Although acid zinc plating baths have been in common use for several decades, their popularity has been foreshadowed by extensive use of alkaline cyanide zinc baths. Among the various drawbacks of acid zinc plating baths are the following:

1. Such baths are limited in their applicability to plating at a low current density. As the current density is raised, the electrodeposit becomes dark, coarse and spongy.
2. The throwing power, i.e. the ability to plate in recesses or at low current densities is not exceptional but instead is moderate.
3. The electrodeposit does not possess a fine textured crystalline structure.
4. The ductility of the electrodeposit is poor, thereby resulting in chipping or peeling of the deposit during flexing or thermal cycling.
5. For satisfactory results, plating must be carried out at elevated temperatures above 28°C and more typically in the range of 38° to 65°C; and
6. Brightness of the electrodeposit is marginal. As a result, the use of acid zinc plating baths has been limited to less demanding applications such as barrel plating and the plating of a continuous protective coating on wire, pipe and the like.

However, waste disposal, toxicity and other problems associated with the use of alkaline cyanide zinc plating baths has caused platers to renew their efforts in perfecting a commercially suitable acid zinc plating bath.

SUMMARY OF THE INVENTION

The present invention overcomes one or more of the drawbacks of the prior art acid zinc baths by the selected use of a small amount of an anionic wetting agent of the type represented by an alkyl phenol polyglycol ether carboxylic acid and a heterocyclic brightener selected from the group consisting of furans, thiophenes and thiazoles.

DETAILED DESCRIPTION OF THE INVENTION

The present invention relates to an acid zinc plating bath and the method of plating which overcomes many of the drawbacks of prior art bright acid processes. More specifically, the bath of this invention produces a bright, ductile zinc coating. Furthermore, the bath has improved throwing power at higher current densities than the acid zinc baths heretofore disclosed. These results are achieved by the synergistic use of an anionic wetting agent comprising a carboxy terminated alkyl phenol polyglycol ether having the following representative structure:

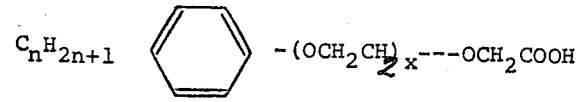

wherein $n$ is typically between 6 and 18 and $x$ is between 8 and 30, and an effective amount of a primary brightener characterized as a heterocyclic compound having the following structural formula:

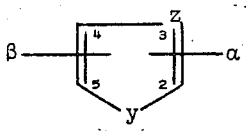

wherein $y$ is either S, O, or $SO_2$ $z$ is either —C or N when $y$ is S or is —C when $y$ is $SO_2$ or O.

$\alpha$ is a 1 to 6 carbon straight or branched chain, saturated or unsaturated substituent containing an aldehyde group, ketone group, an alcohol or a nitrile when $z$ is —C, a mercapto group or hydrazino group where $z$ is N, or is H when $y$ is $SO_2$, and is attached to any available carbon atom on the heterocyclic nucleus at the 2 or 3 position.

When $\alpha$ is hydrogen or an aliphatic chain attached at the 2 position, the compound also includes a hydrogen atom at the 3 position on the heterocyclic ring.

$\beta$ is H or a halogen selected from the group consisting of Cl and Br, and is attached to any available carbon atom in the heterocyclic nucleus or is a phenylene group joined to the heterocyclic ring at the 4 and 5 positions.

The brightener is represented by the group of compounds containing the furan nucleus

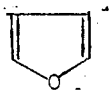

, the thiophene nucleus

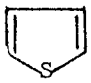

, or the thiazole nucleus

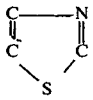

Between 0.1 and 10 g/l of the brightener has been found to be effective. Generally, however, a concentration of less than 2 g/l gives satisfactory results.

The brightener and wetting agent are used in a conventional bright acid zinc electroplating bath along with a source of zinc ions, and a carrier such as sodium benzoate, optionally with the inclusion of a chelating agent or a buffer.

Typical of the wetting agent is a carboxy terminated ethylene oxide adduct of a long chain alkyl phenol or alcohol. The wetting agent contains between 8 and 30 ethylene oxide groups per mole or alkyl phenol or alcohol and between 6 and 18 carbon atoms in the alkyl chain. The molecular weight of the wetting agent is generally at least 400. A specific agent that has been found to be suitable in this invention is Akypo OP 190 manufactured and sold by Chem-Y Chem-y Co. This compound has a formula:

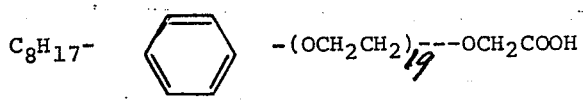

This compound is typically made by reacting the ethylene oxide adduct of octylphenol with chloroacetic acid to introduce the terminal carboxymethyl group into the molecule. When used in an amount of 5 to 25 g/l, the wetting agent serves to prevent pitting and to keep brightener dissolved in the solution.

Representative brighteners of this invention are listed below:

(1) 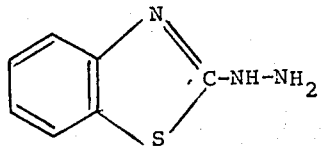

2-hydrazino benzothiazole (2) 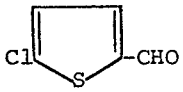

5-chloro-2thiophene carboxaldehyde (3) 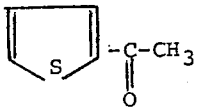

2-acetylthiophene (4) 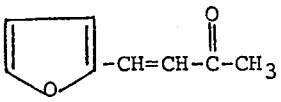

4-(2-furyl)3-butene-2-one (Furfural acetone)

(5) 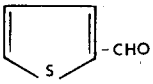

2-thiophene aldehyde (6) 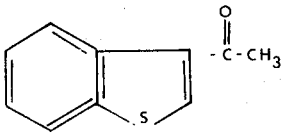

3-acetylthianaphthene (7) 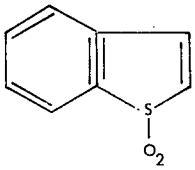

thianaphthene 1-dioxide (8) 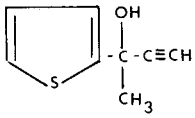

2-thienyl methylethynyl carbinol

-continued (9) 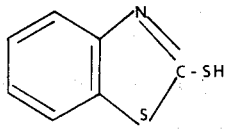

2-mercapto benzothiazole

(10) 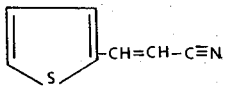

3-(2-thienyl)-acrylonitrile

(11) 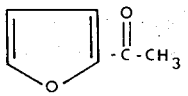

2-acetofuran

These brighteners are typically used in an amount of between about 0.1 g/l and about 10 g/l. The length of the straight or branched side chain on the heterocyclic nucleus will not normally exceed 6 carbon atoms. Above this number, the solubility of the brightener in the plating bath decreases. Also, the presence of longer side chains tend to block the effectiveness of the active heterocyclic nucleus.

Listed below, in the order of increasing effectiveness are various constituents that have been found to be beneficial when present on the branched or straight carbon side chain attached to the heterocyclic nucleus:

| | |
|---|---|
| hydroxy | —OH |
| Carboxylic Acid | —COOH |
| Carboxylic Acid and a double bond | —C=CH—COOH |
| Nitrile Group and a double bond | —C=CH—C≡N |
| Acetylenic bond | —C≡C— |
| Carbonyl Group | >C=O |

The invention can be practiced with any of the conventional acid zinc solutions containing inorganic zinc salts such as zinc sulfate, zinc chloride, zinc fluoborate, zinc acetate, zinc chloroacetate, zinc sulfamate and zinc pyrophosphate in an amount that is adequate to supply between about 6 and 45 g/l of zinc in solution.

Furthermore, the plating bath typically contains a carrier such as a poly alcohol, polyamine, a glycol, ether or ester or an ethoxylated quaternary ammonium compound. One of the most widely used carriers is benzoic acid, usually added to the bath in the form of the alkali salt. When used, the benzoic acid is maintained at a concentration of between about 3 to about 12 g/l in the bath.

In addition to the foregoing, the bath typically contains a suitable complexing agent such as ammonium ions, citrates, or ethylene diamine tetraacetic acid, in an amount of between about 5 and 200 g/l.

The bath is typically operated at a temperature of between 10° and 45°C. and preferably in the range of 20° to 30°C. Current densities between 0.1 and 20 amps/square decimeter (a/dm$^2$) and more preferably between 1 and 12 a/dm$^2$ are commonly used to deposit zinc on ferrous metals, on copper and its alloys, on die cast metals and on other conductive metals such as nickel or cobalt. The thickness of the deposit is between about 0.1 and 0.5 mils.

At current densities above 12 or 15 a/dm$^2$ the electroplater is likely to encounter burning of the deposit.

The following examples are presented to more fully illustrate the invention but without restricting or limiting the scope thereof:

EXAMPLE I

A barrel plating bath of the following composition was prepared:

| | | |
|---|---|---|
| $ZnCl_2$ | 110 | g/l |
| $NH_4Cl$ | 190 | g/l |
| NaBenzoate | 4.2 | g/l |
| 3-acetylthianaphthene | 1.1 | g/l |
| wetting agent - alkylphenol polyglycol ether carboxylic acid (AKYPO OP 190) | 12.25 | g/l |

Zinc die-cast parts were plated in this bath in a plating barrel of 17cm. diameter rotating at from 3 to 16 revolutions per minute. The bath was maintained at a pH of 4.9–5.1. Plating was carried out at 22°C. and at a cathodic current density of between 0.8 and 1.5 amperes per square decimeter.

The parts were completely covered with a deposit that was ductile and had uniform brightness.

EXAMPLE II

A plating bath of the following formulation was prepared:

| | |
|---|---|
| $ZnCl_2$ | 100g/l |
| $NH_4Cl$ | 185 g/l |
| Furfural Acetone [4-(2-furyl)-3 butene-2-one] | 2 g/l |

To this bath were added the following wetting agents with the following results:

a. 11.25 g/l Akypo OP 190 produced a fully bright, level, ductile deposit.

b. 7.5 g/l Atlas Tween 20 (polyoxyethylene sorbitan monolaurate) produced a bright, ductile deposit.

The above examples were carried out at 22°C. using a cathodic current density of 0.5–4 a/dm² in a mechanically agitated bath.

EXAMPLE III

A plating bath having the following formulation was prepared:

| | | |
|---|---|---|
| $ZnCl_2$ | 100 | g/l |
| $NH_4Cl$ | 185 | g/l |
| Akypo OP 190 | 11.25 | g/l |
| Furfural Acetone | 0.1 | g/l |

The addition of 3.0 g/l N-polyvinyl pyrrolidone to the bath produced a deposit that was bright in the high current density area, dull in the medium current density area and dark and dull with misplate on a steel Hull cell panel plated at 1½ amps for 10 minutes with mechanical agitation at room temperature.

A steel Hull cell panel plated in a similar bath including 10 g/l sodium benzoate instead of N-polyvinyl pyrrolidone produced a fully bright deposit over the entire panel area with no burning, dullness or misplate under the same plating conditions as used above.

EXAMPLE IV

A plating bath was prepared using:

| | | |
|---|---|---|
| $ZnCl_2$ | 100 | g/l |
| $NH_4Cl$ | 180 | g/l |
| Akypo OP 190 | 11.25 | g/l |

To this bath was added 1.0 g/l 2-acetylthiophene.

This bath produced a fully bright, level, ductile deposit on a steel panel at the plating conditions of room temeprature (22°C.) using mechanical agitation and at current densities ranging from 0.5 to 4.0 a/dm²,

EXAMPLE V

The following four compounds were each tried in an agitated bath of the type used in Example IV and were found to produce bright, level, ductile deposits at room temperature, on steel panels using current densities in the range of 0.5 to 4.0 a/dm²:

a. 1.0–2.0 g/l 3-acetothionaphthene
b. 1.0–5.0 g/l 2-acetofuran
c. 0.1–1.0 g/l thiophene
d. 0.25–1.0 g/l 2-thiophene carboxaldehyde

EXAMPLE VI

A plating bath was prepared using the following formulation:

| | | |
|---|---|---|
| $Zn(OAc)_2.2H_2O$ | 75 | g/l |
| $ZnCl_2$ | 50 | g/l |
| $NH_4$Citrate | 170 | g/l |
| $NH_4Cl$ | 90 | g/l |
| NaBenzoate | 10.2 | g/l |
| Akypo OP 190 | 8 | g/l |
| 3-Acetothionaphthene | 0.8 | g/l |

This bath produced a bright deposit of reasonable ductility under the plating conditions of Example IV.

It has been found that the plating baths of the present invention have one or more of the following advantages over prior art zinc plating baths:

1. The waste disposal and pollution control problems associated with cyanide zinc baths are minimized.
2. The use of the specified anionic wetting agent eliminates the need of multiple surfactants or wetters in the bath.
3. The bath has high cathode efficiency, good throwing power, and good covering power even at low current densities.
4. The deposit is level and ductile, and when plated from a bath containing sodium benzoate or other good carrier, is fully bright.

Although the foregoing fully describes the present invention including a preferred embodiment thereof, the scope of the invention is limited by the following claims in which I claim:

1. A bright acid zinc aqueous electroplating bath containing an inorganic zinc salt, and improved by the inclusion of:

a. between about 5 and about 25 grams per liter of a carboxy terminated alkyl phenol polyglycol ether wetting agent, and
b. between about 0.1 and about 10 g/l of a heterocyclic compound having the following structural formula:

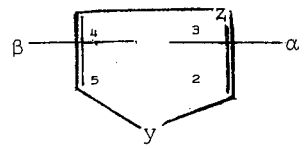

Wherein $y$ is either S, O, or $SO_2$,

Z is either —C or N when $y$ is S, or is —C when $y$ is $SO_2$, or O, $\alpha$ is a saturated or unsaturated aliphatic chain further substituted by a carbonyl, hydroxy, or cyano group when $z$ is —C, or is a mercapto group or hydrazino group when $z$ is N, or is H when $y$ is $SO_2$, and is attached to any available carbon atom on the heterocyclic nucleus at the 2 or 3 position, provided, however, that when $\alpha$ is hydrogen or an aliphatic chain attached at the 2 position, the compound also includes a hydrogen atom attached to —C at the 3 position, and $\beta$ is H or a halogen selected from the group consisting of Cl and Br, and is attached to any available carbon atom in the heterocyclic nucleus, or is a phenylene group attached to the heterocyclic ring at the 4 and 5 positions.

2. The bath of claim 1 wherein the wetting agent has the general formula

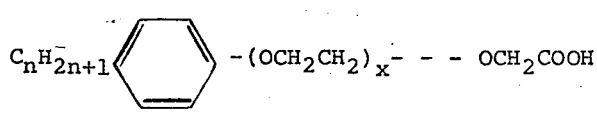

wherein $n$ is between 6 and 18, and $x$ is between 8 and 30.

3. The bath of claim 1 wherein the brightener is a thiophene.

4. The bath of claim 3 wherein the thiophene is selected from the group consisting of 5-chloro-2-thiophene carboxaldehyde
2-acetylthiophene 2-thiophene aldehyde
3-acetylthianaphthene
thianaphthene 1-dioxide
2-thienyl methylethynyl

5. The bath of claim 1 wherein the brightener is a thiazole selected from the group consisting of
2-hydrazino benzothiazole and
2-mercapto benzothiazole

6. The bath of claim 1, including between about 3 and about 12 g/l of benzoic acid as a carrier.

7. A method of electroplating zinc on to a conductive substrate comprising a. Immersing the conductive substrate in an aqueous acid zinc bath composed of an inorganic zinc salt to which is added (1) a heterocyclic brightener, in an amount of between about 0.1 and about 10 g/l, having the following structural formula:

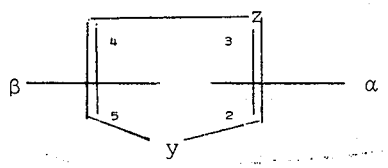

Wherein $y$ is either S, O, or $SO_2$, $z$ is either —C or N when $y$ is S or is —C when $y$ is $SO_2$, or O, $\alpha$ is a saturated or unsaturated aliphatic chain further substituted by a carbonyl, hydroxy, or cyano group when $z$ is —C, or is a mercapto group or hydrazino group when $z$ is N, or is H when $y$ is $SO_2$, and is attached to any available carbon atom on the heterocyclic nucleus at the 2 or 3 position, provided, however, that when $\alpha$ is hydrogen or an aliphatic chain attached at the 2 position, the compound also includes a hydrogen atom attached to —C at the 3 position, and $\beta$ is H or a halogen selected from the group consisting of Cl and Br, and is attached to any available carbon atom in the heterocyclic nucleus, or is a phenylene group attached to the heterocyclic ring at the 4 and 5 positions, and 2. between about 5 and about 25 grams per liter of a carboxy terminated alkyl phenol polyglycol ether wetting agent, and b. passing an electrical current through the bath at a current density of between about 0.1 and 12 a/dm$^2$ to deposit a fully bright layer onto the conductive substrate.

* * * * *